US009284079B2

(12) United States Patent
Hendren et al.

(10) Patent No.: US 9,284,079 B2
(45) Date of Patent: Mar. 15, 2016

(54) TURNTABLE ASSEMBLY FOR STRETCH WRAPPING MACHINE

(71) Applicant: LANTECH.COM, LLC, Louisville, KY (US)

(72) Inventors: Daniel R. Hendren, Mount Washington, KY (US); Gary L. Peters, Louisville, KY (US); Thomas E. Phillips, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 286 days.

(21) Appl. No.: 13/833,988

(22) Filed: Mar. 15, 2013

(65) Prior Publication Data

US 2013/0300047 A1 Nov. 14, 2013

Related U.S. Application Data

(60) Provisional application No. 61/644,000, filed on May 8, 2012.

(51) Int. Cl.
*B65B 11/04* (2006.01)

(52) U.S. Cl.
CPC ..... *B65B 11/045* (2013.01)

(58) Field of Classification Search
CPC ..... B65B 11/045
See application file for complete search history.

(56) References Cited

U.S. PATENT DOCUMENTS

| | | | | |
|---|---|---|---|---|
| 4,281,500 | A * | 8/1981 | Mueller et al. | 53/211 |
| 5,212,933 | A * | 5/1993 | Cere' | 53/556 |
| 5,421,141 | A | 6/1995 | Gordon | |
| 6,848,237 | B2 * | 2/2005 | Lancaster et al. | 53/399 |
| 8,474,224 | B2 * | 7/2013 | Rossi | 53/211 |
| 8,772,651 | B2 * | 7/2014 | Martin et al. | 177/83 |
| 2003/0126833 | A1 * | 7/2003 | Marchetti | 53/211 |
| 2008/0078588 | A1 * | 4/2008 | Draper et al. | 177/145 |
| 2010/0064906 | A1 * | 3/2010 | Rossi | 100/15 |
| 2012/0175170 | A1 * | 7/2012 | Martin et al. | 177/201 |
| 2014/0208696 | A1 * | 7/2014 | Phillips et al. | 53/461 |

FOREIGN PATENT DOCUMENTS

WO WO 2009047620 A2 * 4/2009 ..... B65B 11/04

OTHER PUBLICATIONS

European Patent Office; International Preliminary Report on Patentability in International Patent Application No. PCT/US2013/039881 dated Nov. 11, 2014; 8 pages.
European Patent Office; Search Report and Written Opinion in International Patent Application No. PCT/US2013/039881 dated Oct. 8, 2013; 13 pages.
European Patent Office; Partial Search Report in International Patent Application No. PCT/US2013/039881 dated May 7, 2013; 5 pages.

* cited by examiner

*Primary Examiner* — Joseph J Hail
*Assistant Examiner* — Marc Carlson
(74) *Attorney, Agent, or Firm* — Middleton Reutlinger

(57) ABSTRACT

A turntable assembly for a stretch wrapping machine comprises a frame, a hub rotatably mounted to the frame on a shaft, a turntable mounted to the hub, and a plurality of rollers rotatably mounted to the frame defining a generally horizontal supporting plane for the turntable. Each roller has an axis of rotation generally parallel to the supporting plane and generally passing through the turntable axis of rotation. The frame is constructed so as to elastically deform, upon a load being placed upon the turntable that results in the load not being evenly supported by the rollers, to permit the roller axis of rotation to tilt relative to the horizontal supporting plane while still passing through the turntable axis of rotation.

20 Claims, 6 Drawing Sheets

TURNTABLE ASSEMBLY FOR STRETCH WRAPPING MACHINE

This application claims priority to U.S. Provisional Application Ser. No. 61/644,000 filed May 8, 2012, the disclosure of which is incorporated by reference herein in its entirety.

CROSS-REFERENCE

1. Technical Field

The present disclosure relates to apparatus for wrapping loads with packaging material, and more particularly to apparatus for wrapping plastic film around product on a pallet.

2. Background

Various packaging techniques have been used to assemble a load of unit products and subsequently wrap them for transportation, storage, containment and stabilization, protection and waterproofing. Products are often stacked as a load on a pallet to simplify handling of the products. The pallet load is commonly wrapped with stretch wrap packaging material. One system uses stretch wrapping machines to stretch, dispense, and wrap stretch packaging material around a load. Stretch wrapping can be performed as an inline, automated packaging technique that dispenses and wraps packaging material in a stretched condition around a load on a pallet to cover and contain the load. Pallet stretch wrapping, whether accomplished by a turntable, a rotating arm, or a vertical rotating ring, typically covers the four vertical sides of the load with a stretchable film, such as polyethylene film. In each of these arrangements, relative rotation is provided between the load and the packaging material dispenser to wrap packaging material around the sides of the load.

A turntable type pallet stretch wrapping machine includes a frame, a pulley or hub rotatably mounted to the frame, a turntable mounted on the hub, a vertically movably film dispensing assembly, and a drive mechanism for rotating the hub. The frame includes rollers that rotatably support the underneath surface of the turntable for rotation relative to the film dispensing assembly. A loaded pallet that is to be wrapped with film is placed on the turntable. The loaded pallet is rotated about a generally vertical axis by rotating the turntable with the drive mechanism. The loaded pallet is progressively wrapped circumferentially and vertically, i.e. spirally, by film supplied from a vertically movable roll of film of the film dispensing assembly.

A loaded pallet is typically placed upon the turntable with a forklift or pallet jack. If the loaded pallet is not raised to a sufficient height by the operator of the forklift or pallet jack as the loaded pallet is being positioned over the turntable, the edge of the pallet can strike the edge of the turntable, which can cause plastic deformation, i.e. permanent bending, of the shaft that rotatably mounts the hub to the frame, thus requiring repair. The edge of the turntable can also be struck by other objects or machines encountered in a typical warehouse environment that could cause permanent bending of the shaft. For example, the edge of the turntable could be struck by the tines of a fork truck or pallet jack, the mast of a fork truck, or even by an unpalletized load itself.

Another difficulty associated with placing the loaded pallet upon the turntable is accurately placing the pallet in the center of the turntable. If the loaded pallet is placed on the turntable offset from the rotational axis of the turntable, the weight of the loaded pallet will not be evenly supported by the turntable rollers. Even if the loaded pallet is placed in the center of the turntable, if the load is not evenly distributed on the pallet the same situation can occur. And, even if the loaded pallet is placed in the center of the turntable, and even if the load is evenly distributed on the pallet, the weight of the loaded pallet might still not be evenly supported by the turntable rollers, due to manufacturing tolerances in the production of the frame, turntable, pulley/hub, etc., or due to the effects of the weight distribution of the load in combination with the dynamics of the turntable. All of these scenarios can cause increased wear on the rollers and increased vibration during rotation of the turntable.

Accordingly, a need therefore exists for a stretch wrapping machine turntable assembly that overcomes the drawbacks of conventional stretch wrapping machine turntable assemblies such as those described above.

SUMMARY

The present invention overcomes the foregoing and other shortcomings and drawbacks of conventional turntable assemblies used in stretch wrapping machines. While the invention will be described in connection with certain embodiments, it will be understood that the invention is not limited to these embodiments. On the contrary, the invention includes all alternatives, modifications, and equivalents as may be included within the spirit and scope of the present invention.

According to one aspect of the present invention, a turntable assembly for a stretch wrapping machine comprises a frame, a turntable mounted to the frame for rotation about a generally vertical turntable axis of rotation, and a plurality of rollers rotatably mounted to the frame and defining a generally horizontal supporting plane for supporting the turntable. Each of the plurality of rollers has an axis of rotation generally parallel to the supporting plane and generally passing through the turntable axis of rotation. The frame is constructed of a material and of a geometry so as to elastically deform, upon a load being placed upon the turntable that results in the load not being evenly supported by the rollers, to permit the axis of rotation of at least one roller of the plurality of rollers to tilt relative to the horizontal supporting plane while still passing through the turntable axis of rotation.

The plurality of rollers can comprise a plurality of pairs of rollers, each pair of rollers of the plurality of pairs of rollers being mounted on a respective frame member of the frame such that one roller of the pair of rollers is positioned on one side of the frame member and the other roller of the pair of rollers is positioned on the other side of the frame member. In one embodiment, each frame member can be constructed such that the deflection under load conditions will not exceed the yield strength of the material of the frame member. Each frame member can be constructed of a material and of a geometry so as to elastically deform an amount sufficient to permit the roller pair axis of rotation to tilt about 3 degrees when a load of about 3,500 pounds is placed on one roller of the pair of rollers. For example, each frame member can be generally rectangular in cross section having a height of about 2.0 inches and a width of about 0.25 inches, and can be fabricated of A36 steel. The pair of rollers can be positioned generally midway along a length of the frame member. The frame member can have a reduced height between the pair of rollers and each end of the frame member if desired. Alternatively the pair of rollers can be positioned near one end of the frame member, and the frame member can have a reduced height at the end near which the pair of rollers is positioned.

In another aspect of the present invention, a turntable assembly for a stretch wrapping machine comprises a frame, a hub rotatably mounted to the frame on a shaft, and a turntable mounted to the hub for rotation about a generally vertical turntable axis of rotation. The frame includes hub deflection limiting structure spaced around the turntable axis of rotation at about 0 degrees, at about 90 degrees, and at about 180 degrees. The deflection limiting structure is spaced from the hub by an amount such that if the turntable is struck causing the hub to bend the shaft, the shaft will elastically deform rather than plastically deform.

The frame of the turntable assembly can comprise a generally circular outer frame member, a pair of generally longitudinally oriented frame members connected to the outer frame member, one of the pair of longitudinally oriented frame members being located on one side of the hub and the other of the pair of longitudinally oriented frame members being located on the other side of the hub, and a generally transversely oriented frame member connected to the pair of generally longitudinally oriented frame members. For example, each of the pair of generally longitudinally oriented frame members can be spaced from an outer edge of the hub by about 3/32 inches, and the generally transversely oriented frame member can be spaced from an outer edge of the hub by about 3/32 inches.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description given below, serve to explain the principles of the invention.

DETAILED DESCRIPTION

Reference will now be made to the present embodiments of the disclosure, examples of which are illustrated in the accompanying figures. Wherever possible, the same reference numbers will be used throughout the figures to refer to the same or like parts.

Figure 1:
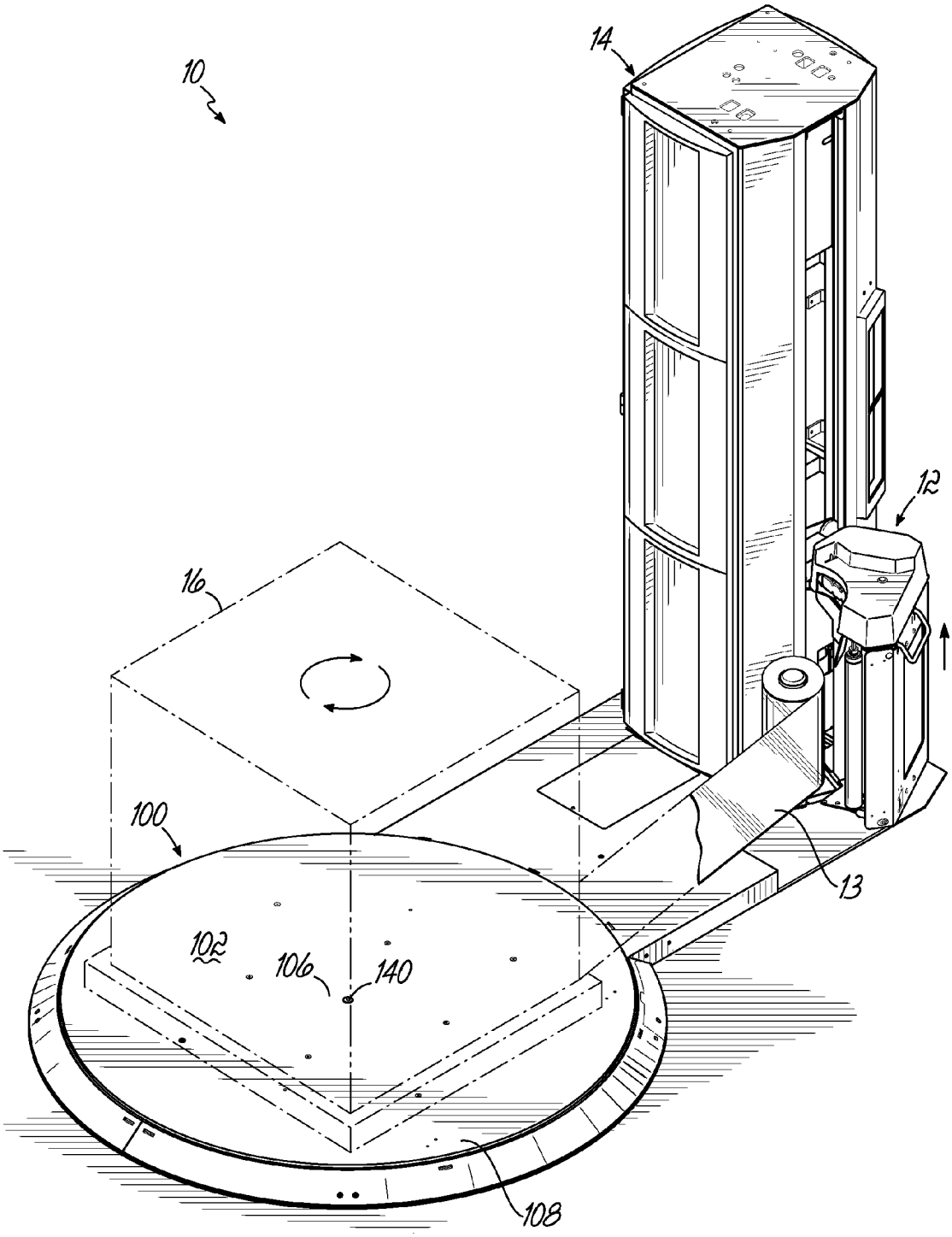
FIG. 1 is a perspective view of an exemplary apparatus for wrapping a load, including an exemplary turntable assembly in accordance with the principles of the present disclosure.

As shown in FIG. 1, a wrapping apparatus 10 includes a packaging material dispenser 12 configured to dispense packaging material 13 onto a load 16. Packaging material dispenser 12 may be configured to travel substantially vertically up and down a support column 14 while dispensing the packaging material 13. The vertical movement of packaging material dispenser 12 and the relative rotation between load 16 and packaging material dispenser 12 provides for wrapping of load 16 with the packaging material 13 in a spiral fashion, as would be apparent to one skilled in the art.

Figure 2:
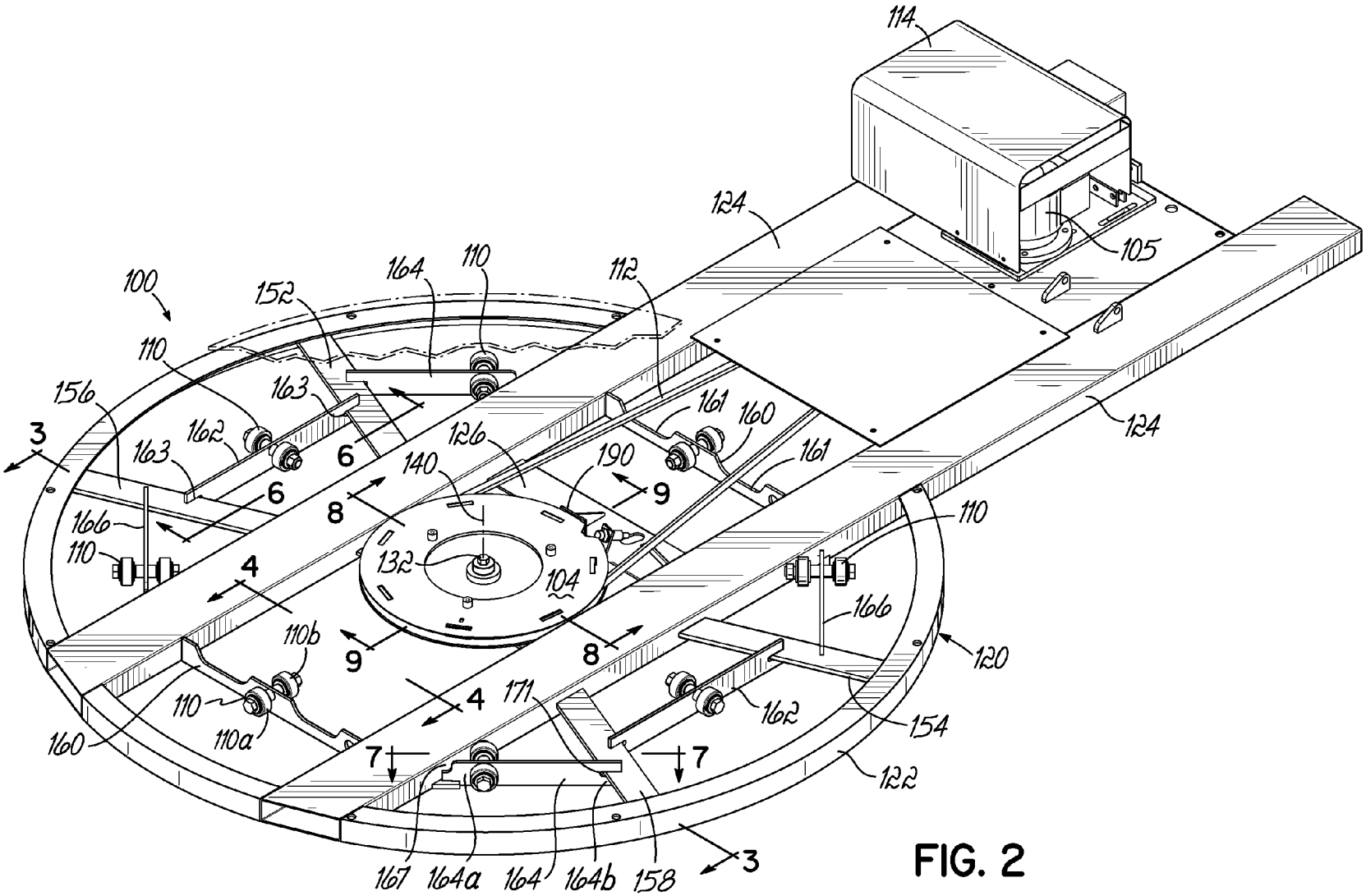
FIG. 2 is an enlarged perspective view of the turntable assembly of FIG. 1, with the turntable removed.
Figure 3:
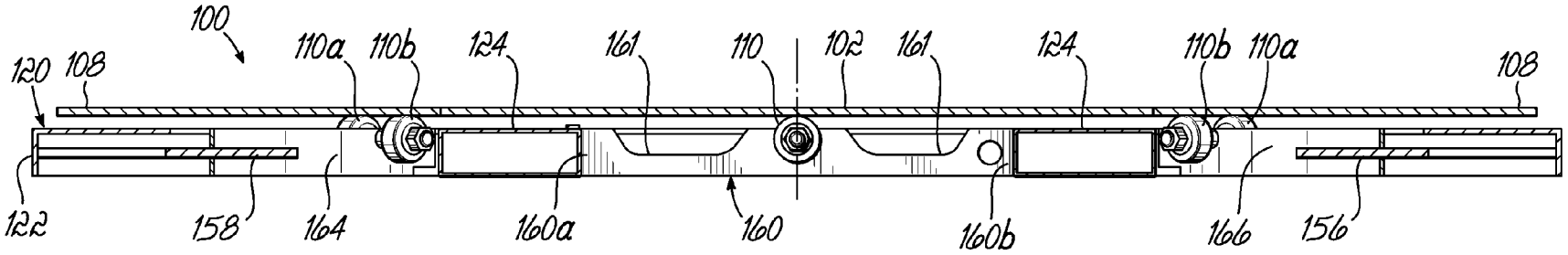
FIG. 3 is a view taken along line 3-3 in FIG. 2.

Relative rotation between packaging material dispenser 12 and load 16 may be provided by a turntable assembly 100, shown in FIGS. 1 and 2. Turntable assembly 100 may include a turntable 102 upon which load 16 rests. In FIG. 2, turntable 102 has been removed to expose turntable assembly components underneath. As shown in FIG. 2, turntable assembly 100 includes a pulley or hub 104. A central portion 106 of turntable 102 may be coupled to pulley 104 such that turntable 102 may rotate as pulley 104 rotates. An outer portion 108 of turntable 102 engages rollers 110. Rollers 110 are configured to rotatably support outer portion 108 of turntable 102 and define a generally horizontal supporting plane for turntable 102.

A belt 112 operatively couples pulley 104 and a drive mechanism 114. Belt 112 is in tension, and engages portions of pulley 104 and drive mechanism 114. The drive mechanism 114 may include, for example, a motor 105 configured to engage and drive belt 112. Belt 112, pulley 104, and the drive mechanism 114 may form a drive assembly. When belt 112 is driven, belt 112 causes rotation of pulley 104, turntable 102, and load 16. Drive elements other than belts and pulleys may be used.

Figure 8:
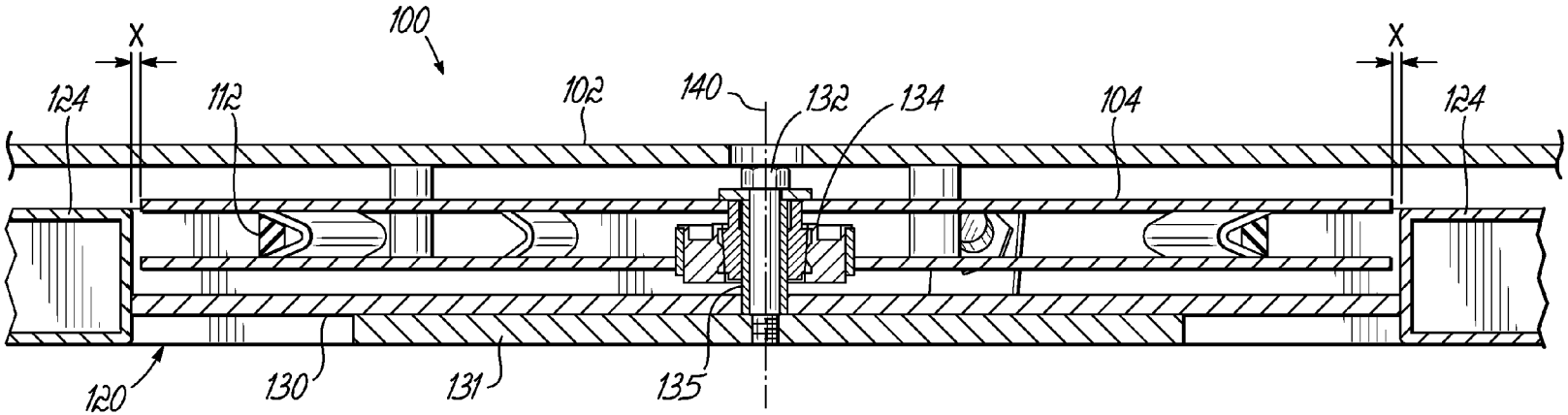
FIG. 8 is a view taken along line 8-8 in FIG. 2.
Figure 9:
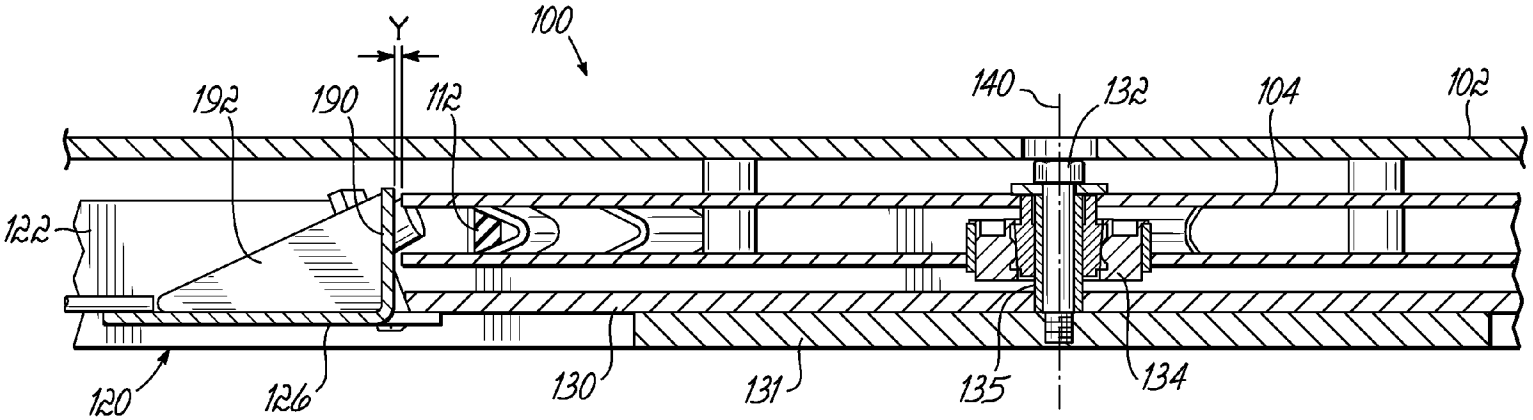
FIG. 9 is a view taken along line 9-9 in FIG. 2.

Referring to FIGS. 2, 8, and 9, turntable assembly 100 further includes a frame 120 including a generally circular outer frame member or beam 122, a pair of generally longitudinally oriented frame members or beams 124, 124 connected to the outer frame member 122, and a generally transversely oriented frame member or beam 126 connected to the pair of generally longitudinally oriented frame members 124, 124. Frame 120 further includes a base plate 130 connected to the pair of generally longitudinally oriented frame members 124, 124. Pulley or hub 104 is rotatably mounted to base plate 130 via a shaft, for example bolt 132 threaded into backer bar 131 below base plate 130, a bearing 134, and a spacer 135, for rotation about a generally vertical turntable axis of rotation 140. While a bolt with spacer is illustrated as being used to rotatably mount pulley 104 to base plate 130, other elements such as a shaft, a pin, an axle, a rod, and the like could be used. Accordingly, the term "shaft" as used herein shall be deemed to generically embrace bolts, spacers, shafts, pins, axles, rods, and the like. Frame 120 further includes cross frame members or cross straps 152, 154, 156, 158 interconnecting outer frame member 122 and the pair of generally longitudinally oriented frame members 124, 124. The various frame members of frame 120 can be fabricated of, for example, steel, and can be connected where indicated as by welding or the like.

Referring to FIGS. 2-7, it will be seen that frame 120 further includes a number of additional frame members or beams or plates mounting rollers 110 to frame 120. More particularly, a first pair of frame members or beams 160, 160 are connected between the pair of generally longitudinally oriented frame members 124, 124 at approximately the 12 o'clock and 6 o'clock positions relative to the circular outer frame member 122 (the 12 o'clock position being nearest the dispenser 12 and column 14). A second pair of frame members or beams 162, 162 are connected between straps 152, 156 and 154, 158, respectively at approximately the 3 o'clock and 9 o'clock positions relative to the circular outer frame member 122. A third pair of frame members or beams 164, 164 are connected between strap 152 and one of the generally longitudinally oriented frame members 124, and between strap 158 and the other of the generally longitudinally oriented frame members 124, respectively, at approximately the 10:30 o'clock and 4:30 o'clock positions relative to the circular outer frame member 122. A fourth pair of frame members or beams 166, 166 are connected between strap 154 and one of the generally longitudinally oriented frame members 124, and between strap 156 and the other of the generally longitudinally oriented frame members 124, respectively, at approximately the 1:30 o'clock and 7:30 o'clock positions relative to the circular outer frame member 122. The frame members of frame member pair 160, 160 are substantially identical to one another. Similarly, the frame members of frame member pair 162, 162 are substantially identical to one another. Similarly, the frame members of frame member pairs 164, 164 and 166, 166 are all substantially identical to one another; however, the frame members of frame member pair 164, 164 are flipped end-to-end relative to one another as assembled, as are the frame members of frame member pair 166, 166.

Figure 5A:
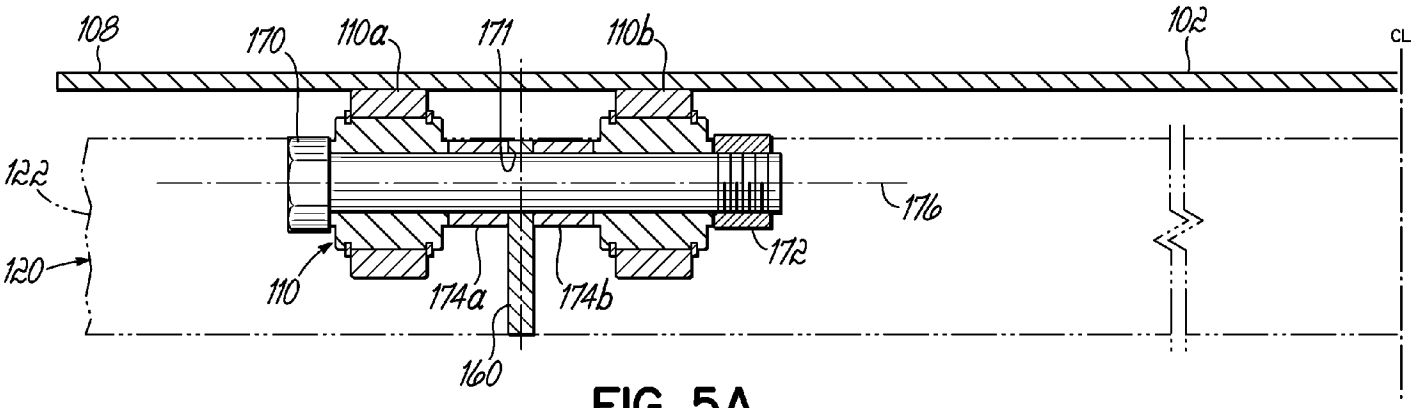
FIG. 5A is a view taken along line 5A-5A in FIG. 4.
Figure 5B:
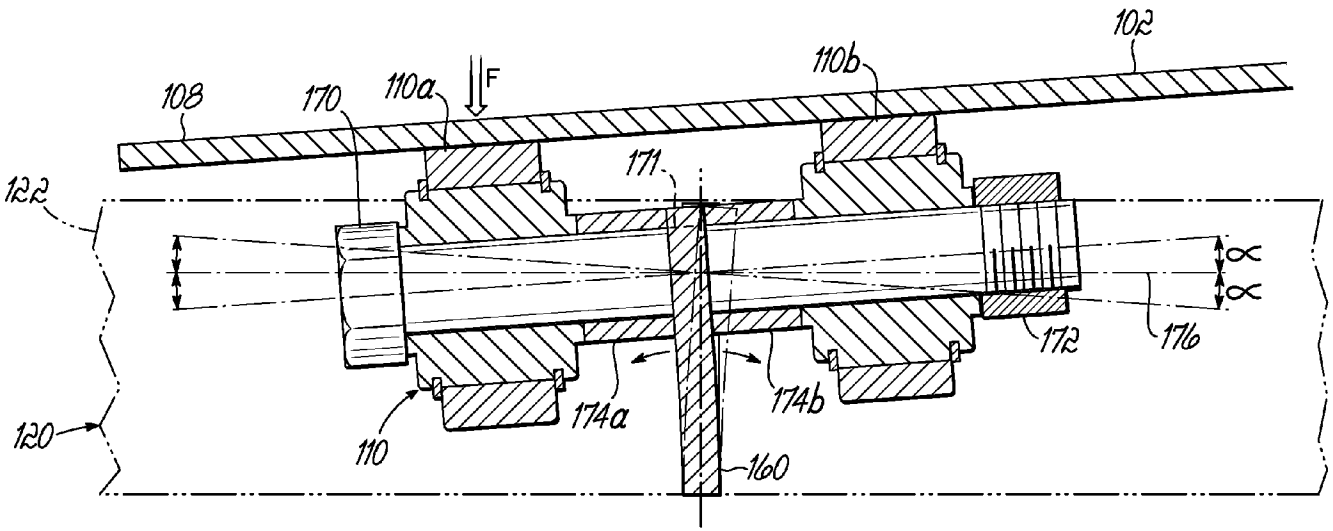
FIG. 5B is a view similar to FIG. 5A but in the deflected position.

The first, second, third, and fourth pairs of frame members 160, 160; 162, 162; 164, 164; and 166, 166 support the rollers 110. Each roller 110 preferably includes first and second rollers such as roller bearings 110*a*, 110*b* located on opposite sides of a respective frame member and spaced from each other (centerline-to-centerline) by about 2.76 inches. Referring to FIG. 5A, it will be seen that rollers 110*a*, 110*b* are secured to frame member 160 via bolt 170 passing through roller 110*a*, spacer 174*a*, hole 171 in frame member 160, spacer 174*b*, and roller 110*b*, and secured with nut 172, for rotation about an axis 176. Rollers 110*a*, 110*b* are secured to frame members 162, 164, and 166 in a similar fashion. To accommodate for uneven loading of the rollers 110*a*, 110*b*, for example when a force F is centered over one of the rollers 110*a*, 110*b* as is shown in FIG. 5B rather than equally between them, the material and geometry of the roller supporting frame members or beams are selected so as to provide a degree of flexibility of the frame members. This permits the frame member or beam to elastically deform to permit the axis of rotation 176 of the rollers 110*a*, 110*b* to tilt by an angle $\alpha$ relative to the horizontal supporting plane to maintain contact of rollers 110*a*, 110*b* with the underneath side of the turntable 102, thus maintaining substantially even load distribution between the two rollers. Advantageously, when the frame member deflects thus tilting axis 176 of the rollers 110*a*, 110*b*, the axis 176 nevertheless continues to still substantially pass through the turntable axis of rotation 140, thereby avoiding the undesirable "toe-in/toe-out" effect that some prior attempts at solving the uneven load distribution problem suffer from. Toe-in/toe-out is undesirable in that it creates additional friction/heat, wear on the rollers, wear on the motor, etc., as the turntable 102 is rotated with drive mechanism 114. The above-described assembly avoids toe-in/toe-out due to the bolt connection of the rollers 110*a*, 110*b* to its respective frame member via bolt 170, spacers 174*a*, 174*b*, and nut 176, torqued sufficiently to impart sufficient preload on the bolted joint.

As mentioned above, the desired stiffness or spring rate of the roller supporting frame members or beams can be obtained through the selection of a number of variables, such as the material of the frame members, the cross-section of the frame members, the length of the frame members, the position of the rollers along the frame members, the "end conditions" of the frame members, i.e. how the ends of the frame members are attached to adjacent structure (welding generally makes for a stiffer connection and hence a stiffer frame member, whereas bolting/screwing generally makes for a less stiff connection and hence a less stiff frame member, whereas pinning/riveting generally makes for an even less stiff connection and hence an even less stiff frame member, for example), and the like. One example of such a combination of variables that produces an acceptable stiffness or spring rate is to fabricate the frame members or beams from A36 steel with a rectangular cross-section having a height of about 2 inches and a width of about 0.25 inches, in combination with the following lengths and end conditions of the frame members or beams.

Figure 4:
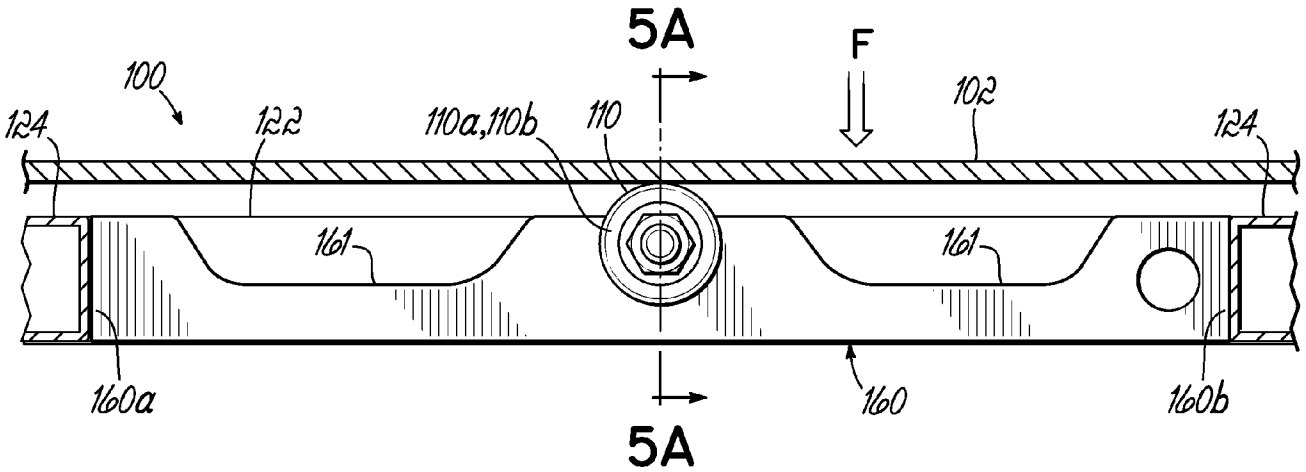
FIG. 4 is a view taken along line 4-4 in FIG. 2.

Referring to FIG. 4, for frame members 160, 160 the rollers 110*a*, 110*b* are positioned generally midway along a length of the frame member. Frame members 160, 160 can include reduced height areas 161, 161 between the pair of rollers 110*a*, 110*b* and each end of frame member 160. Each end 160*a*, 160*b* of each frame member 160 is welded to one of the pair of generally longitudinally oriented frame members 124. While these reduced height areas 161, 161 are to provide clearance for belt 112 (FIG. 2), they can also be utilized to reduce the stiffness or spring rate of the frame member to produce the desired stiffness or spring rate. Frame members 160 are about 18.3 inches long.

Figure 6:
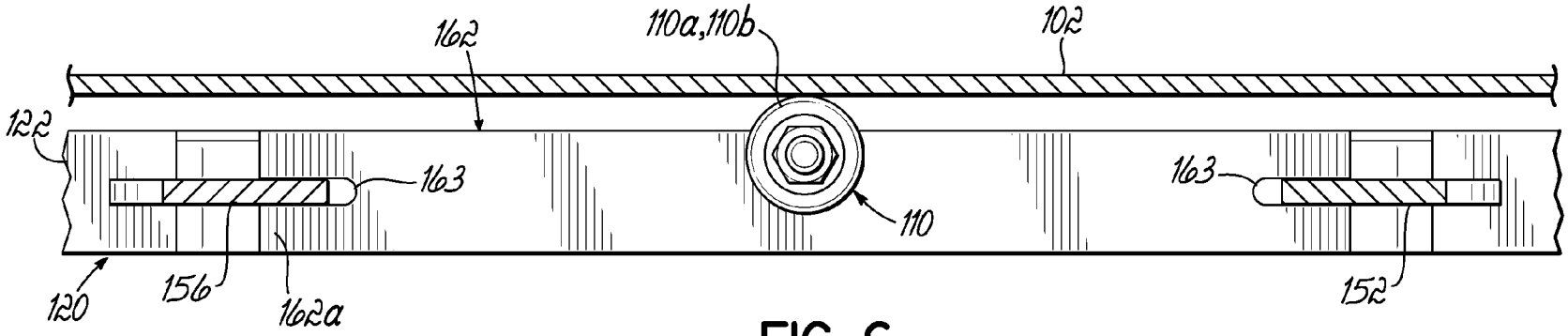
FIG. 6 is a view taken along line 6-6 in FIG. 2.

Referring to FIG. 6, for frame members 162, 162 the rollers 110*a*, 110*b* are also positioned generally midway along a length of the frame member. Each end 162*a*, 162*b* of each frame member 162 is slotted as at 163 to accommodate a respective one of the cross straps 152, 156 or 154, 158, and is welded thereto. Frame members 162 are about 17.75 inches long.

Figure 7:
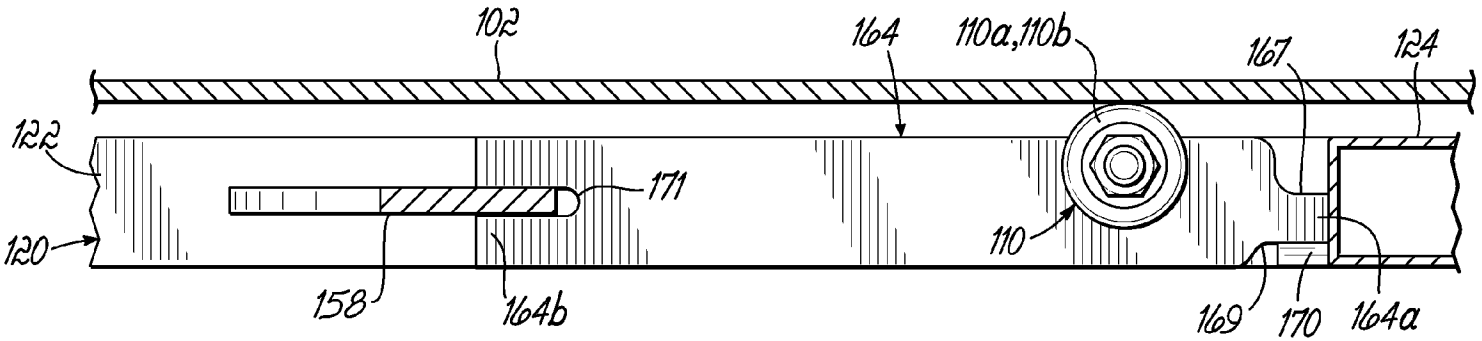
FIG. 7 is a view taken along line 7-7 in FIG. 2.

Referring to FIG. 7, for frame members 164, 164 and 166, 166 the rollers 110*a*, 110*b* are positioned near one end of the frame member, due to the desire to equally space the rollers around the frame 120 and due to geometric constraints imposed by the various other frame members of the frame 120. Since locating the rollers 110*a*, 110*b* near one end of the frame member makes for a higher stiffness or spring rate, a reduced height area for frame member 164 and 166 is desirable to reduce the stiffness or spring rate to generally match that of the other frame members 160, 162. To that end, a reduced height area 167 is included on an upper side and at that end 164*a* of the frame member 164, i.e. between the rollers 110*a*, 110*b* and the connection to adjacent structure, which in this case is one of the pair of generally longitudinally oriented frame members 124. End 164*a* includes a further reduced height area on a lower side thereof in the form of a notch 169 that is supported on a tang 170 that is welded to the generally longitudinally oriented frame member 124. End 164*a* is welded to tang 170 and to frame member 124. The other end 164*b* of frame member 164 is slotted as at 171 to accommodate a respective one of the cross straps 152, 154, 156, 158, and is welded thereto. Frame members 164 and 166 are about 13 inches long.

The above-described roller supporting frame member materials, frame member cross-sectional shapes and dimensions, frame member lengths, positions of the rollers along the lengths of the frame members, and frame member end conditions are merely illustrative and exemplary; other materials, shapes, dimensions, lengths, roller positions, and end conditions can also be used to produce acceptable stiffnesses/spring rates. It is believed that the above-described materials, shapes, dimensions, lengths, roller positions, and end conditions produce about a 3 degree angle of tilt a if a 3,500 pound point load is placed at the centerline of one of the rollers 110*a*, 110*b*, as shown in FIG. 5B, as predicted via numerical simulation, i.e. via finite element analysis. Other stiffnesses/spring rates can be used; the 1166.67 pounds per degree stiffness/spring rate is merely illustrative and exemplary.

As mentioned above, frame 122 of turntable assembly 120 includes a pair of generally longitudinally oriented frame members or beams 124, 124 connected to the outer frame member 122, and a generally transversely oriented frame member or beam 126 connected to the pair of generally longitudinally oriented frame members 124, 124. Hub or pulley 104 is rotatably mounted to base plate 130 of frame 122 via shaft 132. As shown in FIGS. 8 and 9, generally longitudinally oriented frame members or beams 124, 124 and generally transversely oriented frame member or beam 126 function as hub deflection limiting structure spaced around the turntable axis of rotation (as viewed in FIG. 2) at about 0 degrees (3 o'clock position in illustrated embodiment), at about 90 degrees (12 o'clock position in illustrated embodiment), and at about 180 degrees (9 o'clock position as illustrated). The generally longitudinally oriented frame members or beams 124, 124 are each spaced from an outer edge of the hub or pulley 104 by a distance X of about 3/32 inches. This distance is such that if the turntable is struck with a pallet or other structure at either the 3 o'clock position or at the 9 o'clock position causing the hub 104 to bend the shaft 132 and/or spacer 135, the shaft 132 and/or spacer 135 will only elastically deform rather than plastically deform. Similarly, and as shown in FIG. 9, the generally transversely oriented frame member or beam 126 is spaced from an outer edge of the hub or pulley 104 by a distance Y of about 3/32 inches, likewise a distance such that if the turntable is struck with a pallet or other structure at the 6 o'clock location causing the hub 104 to bend the shaft 132 and/or spacer 135, the shaft 132 and/or spacer 135 will only elastically deform rather than plastically deform. Note that a pallet generally cannot be loaded from the 12 o'clock position with a forklift or pallet jack due to interference from the dispensing assembly 12 and tower 14, and so hub deflection limiting structure is generally not necessary at the 6 o'clock position. Since generally transversely oriented frame member 126 is generally located below the pulley or hub 104 (unlike frame members 124, 124 which are generally aligned with pulley or hub 104), the frame member 126 can include an upturned portion 190 braced by gusset 192 to perform the hub deflection limiting function.

The above distances X and Y are a function of, among other things, the yield strength of the material from which the shaft 132 and/or spacer 135 are fabricated. For example, bolt 132 was chosen to be an M12 class 10.9 hex head bolt, and spacer 135 was chosen to be a length of 1018 cold-rolled hex head rod, the lower end of which is non-rotatably mounted in a mating hex hole in base plate 130. In addition, base plate 130 was chosen to be fabricated of A36 steel having a length of about 18 inches, a width of about 8 inches, and a thickness of about 0.25 inches, and backer bar 131 was chosen to be fabricated of A36 steel having a length of about 12 inches, a width of about 2 inches, and a thickness of about 0.5 inches. These materials, shapes, sizes, etc., and distances X and Y, are merely illustrative and exemplary; other materials, shapes, sizes, etc., and distances X and Y can also be used to produce acceptable results.

While the present invention has been illustrated by the description of one or more embodiments thereof, and while the embodiments have been described in considerable detail, they are not intended to restrict or in any way limit the scope of the appended claims to such detail. For example, while roller pairs have been shown and described, the invention could as well be practiced with single rollers cantilevered from their supporting structure. The various features shown and discussed herein may be used alone or in combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A turntable assembly for a stretch wrapping machine, said turntable assembly comprising:

a frame, a turntable mounted to said frame for rotation about a generally vertical turntable axis of rotation, and a plurality of rollers rotatably mounted to said frame and defining a generally horizontal supporting plane for supporting said turntable, each of said plurality of rollers having an axis of rotation generally parallel to the supporting plane and generally passing through the turntable axis of rotation, said frame constructed of a material and of a geometry so as to elastically deform, upon a load being placed upon said turntable that results in the load not being evenly supported by said rollers, to permit the axis of rotation of at least one roller of said plurality of rollers to tilt relative to the horizontal supporting plane while still passing through the turntable axis of rotation, said frame including a generally flat frame member having a generally rectangular cross-section extending in a generally vertical direction with a hole formed therein through a thinnest width of the generally rectangular cross-section and extending along an axis generally parallel to the horizontal supporting plane, said at least one roller being rigidly mounted to said frame member through said hole with said axis of rotation in a generally parallel relationship with the axis of the hole, wherein said frame member is constructed of a material and of a geometry so as to elastically deform in response to a force applied to said at least one roller by the load while maintaining the generally parallel relationship with the axis of the hole to which said at least one roller is rigidly mounted.

2. The turntable assembly of claim 1 wherein said plurality of rollers comprises a plurality of pairs of rollers, each pair of rollers of said plurality of pairs of rollers being mounted on a respective frame member of said frame such that one roller of said pair of rollers is positioned on one side of said frame member and the other roller of said pair of rollers is positioned on the other side of said frame member.

3. The turntable assembly of claim 2 wherein each said frame member is constructed of a material and of a geometry such that the frame member will deflect without exceeding yield strength of the material when a load of about 3,500 pounds is placed on one roller of said pair of rollers.

4. The turntable assembly of claim 2 wherein each said frame member is constructed of a material and of a geometry so as to elastically deform an amount sufficient to permit the roller pair axis of rotation to tilt about 3 degrees when a load of about 3,500 pounds is placed on one roller of said pair of rollers.

5. The turntable assembly of claim 4 wherein each said frame member is generally rectangular in cross section having a height of about 2.0 inches and a width of about 0.25 inches, and is fabricated of A36 steel.

6. The turntable assembly of claim 2 wherein a first pair of rollers among said plurality of pairs of rollers is positioned generally midway along a length of said respective frame member.

7. The turntable assembly of claim 6 wherein said respective frame member of said first pair of rollers has a reduced height between said first pair of rollers and each end of said respective frame member.

8. The turntable assembly of claim 2 wherein a first pair of rollers among said plurality of pairs of rollers is positioned near one end of said respective frame member, said respective frame member of said first pair of rollers having a reduced height at the end near which said first pair of rollers is positioned to reduce a stiffness of said frame member proximate the end near which said pair of rollers is positioned to generally match that of another respective frame member of said frame.

9. The turntable assembly of claim 1, wherein said plurality of rollers includes a first pair of rollers, said first pair of rollers being mounted on said frame member such that one roller of said first pair of rollers is positioned on one side of said frame member and the other roller of said first pair of rollers is positioned on the other side of said frame member, said first pair of rollers mounted to said frame member through a bolt extending through said hole and through which the axis of rotation projects, said turntable assembly further comprising a nut securing said first pair of rollers to said frame member and torqued to impart a preload to a joint between said first pair of rollers and said frame member.

10. A turntable assembly for a stretch wrapping machine, said turntable assembly comprising:

a frame, a hub rotatably mounted to said frame on a shaft, and a turntable mounted to said hub for rotation about a generally vertical turntable axis of rotation, said frame including hub deflection limiting structure spaced around the turntable axis of rotation at about 0 degrees, at about 90 degrees, and at about 180 degrees, said deflection limiting structure spaced from said hub by an amount such that if said turntable is struck in a direction generally transverse to the turntable axis of rotation causing said hub to bend said shaft, said shaft will elastically deform rather than plastically deform, a portion of said hub deflection limiting structure disposed at about 90 degrees around the turntable axis of rotation and spaced from said hub an amount such that said hub will contact the portion of said hub deflection limiting structure prior to plastic deformation of said shaft.

11. The turntable assembly of claim 10 wherein said frame further comprises:

a generally circular outer frame member, a pair of generally longitudinally oriented frame members connected to said outer frame member, one of said pair of longitudinally oriented frame members being located on one side of said hub and the other of said pair of longitudinally oriented frame members being located on the other side of said hub, and a generally transversely oriented frame member connected to said pair of generally longitudinally oriented frame members, wherein the portion of said hub deflection limiting structure is disposed on said generally transversely oriented frame member, each of said pair of generally longitudinally oriented frame members spaced from an outer edge of said hub by about 3/32 inches, said generally transversely oriented frame member spaced from an outer edge of said hub by about 3/32 inches.

12. A turntable assembly for a stretch wrapping machine, said turntable assembly comprising:

a frame, a hub rotatably mounted to said frame on a shaft, a turntable mounted to said hub for rotation about a generally vertical turntable axis of rotation, and a plurality of rollers rotatably mounted to said frame and defining a generally horizontal supporting plane for supporting said turntable, each of said plurality of rollers having an axis of rotation generally parallel to the supporting plane and generally passing through the turntable axis of rotation, said frame constructed of a material and of a geometry so as to elastically deform, upon a load being placed upon said turntable that results in the load not being evenly supported by said rollers, to permit the axis of rotation of at least one roller of said plurality of rollers to tilt relative to the horizontal supporting plane while still passing through the turntable axis of rotation, said frame including a generally flat frame member having a generally rectangular cross-section extending in a generally vertical direction with a hole formed therein through a thinnest width of the generally rectangular cross-section and extending along an axis generally parallel to the horizontal supporting plane, said at least one roller being rigidly mounted to said frame member through said hole with said axis of rotation in a generally parallel relationship with the axis of the hole, wherein said frame member is constructed of a material and of a geometry so as to elastically deform in response to a force applied to said at least one roller by the load while maintaining the generally parallel relationship with the axis of the hole to which said at least one roller is rigidly mounted, said frame including hub deflection limiting structure spaced around the turntable vertical axis of rotation at about 0 degrees, at about 90 degrees, and at about 180 degrees, said deflection limiting structure spaced from said hub by an amount such that if said turntable is struck in a direction generally transverse to the turntable vertical axis of rotation causing said hub to bend said shaft, said shaft will elastically deform rather than plastically deform.

13. The turntable assembly of claim 12 wherein said plurality of rollers comprises a plurality of pairs of rollers, each pair of rollers of said plurality of pairs of rollers being mounted on a respective frame member of said frame such that one roller of said pair of rollers is positioned on one side of said frame member and the other roller of said pair of rollers is positioned on the other side of said frame member.

14. The turntable assembly of claim 13 wherein each said frame member is constructed of a material and of a geometry so as to elastically deform an amount sufficient to permit the roller pair axis of rotation to tilt about 3 degrees when a load of about 3,500 pounds is placed on one roller of said pair of rollers.

15. The turntable assembly of claim 14 wherein each said frame member is generally rectangular in cross section having a height of about 0.25 inches and a width of about 2.0 inches, and is fabricated of A36 steel.

16. The turntable assembly of claim 13 wherein a first pair of rollers among said plurality of pairs of rollers is positioned generally midway along a length of said respective frame member.

17. The turntable assembly of claim 16 wherein said respective frame member of said first pair of rollers has a reduced height between said first pair of rollers and each end of said respective frame member.

18. The turntable assembly of claim 13 wherein a first pair of rollers among said plurality of pairs of rollers is positioned near one end of said respective frame member, said respective frame member of said first pair of rollers having a reduced height at the end near which said first pair of rollers is positioned to reduce a stiffness of said frame member proximate the end near which said pair of rollers is positioned to generally match that of another respective frame member of said frame.

19. The turntable assembly of claim 12 wherein said frame further comprises:

a generally circular outer frame member, a pair of generally longitudinally oriented frame members connected to said outer frame member, one of said pair of longitudinally oriented frame members being located on one side of said hub and the other of said pair of longitudinally oriented frame members being located on the other side of said hub, and a generally transversely oriented frame member connected to said pair of generally longitudinally oriented frame members, wherein a portion of said generally transversely oriented frame member is spaced from said hub an amount such that said hub will contact the portion of said hub deflection limiting structure prior to plastic deformation of said shaft, each of said pair of generally longitudinally oriented frame members spaced from an outer edge of said hub by about 3/32 inches, said generally transversely oriented frame member spaced from an outer edge of said hub by about 3/32 inches.

20. The turntable assembly of claim 12, wherein said plurality of rollers includes a first pair of rollers, said first pair of rollers being mounted on said frame member such that one roller of said first pair of rollers is positioned on one side of said frame member and the other roller of said first pair of rollers is positioned on the other side of said frame member, said first pair of rollers mounted to said frame member through a bolt extending through said hole and through which the axis of rotation projects, said turntable assembly further comprising a nut securing said first pair of rollers to said frame member and torqued to impart a preload to a joint between said first pair of rollers and said frame member.

* * * * *